US005984310A

United States Patent [19]

English

[11] Patent Number: 5,984,310

[45] Date of Patent: Nov. 16, 1999

[54] METHOD FOR PLAYING A WAGERING TYPE CARD GAME

[76] Inventor: Toby J. English, 540 Windsor Dr., Lincoln, Nebr. 68528

[21] Appl. No.: 09/063,239

[22] Filed: Apr. 20, 1998

[51] Int. Cl.[6] ..... A63F 1/00

[52] U.S. Cl. ..... 273/292

[58] Field of Search ..... 273/292, 274, 273/309; 463/13, 12

[56] References Cited

U.S. PATENT DOCUMENTS

| | | | |
|---|---|---|---|
| 4,648,604 | 3/1987 | Horan | 273/292 |
| 4,651,997 | 3/1987 | Wood | 273/274 |
| 4,743,022 | 5/1988 | Wood | 463/13 |
| 4,836,553 | 6/1989 | Suttle et al. | 273/292 |
| 4,861,041 | 8/1989 | Jones et al. | 273/292 |
| 5,022,653 | 6/1991 | Suttle et al. | 463/13 |
| 5,033,744 | 7/1991 | Bridgeman et al. | 463/13 |
| 5,042,818 | 8/1991 | Weingardt | 273/292 |
| 5,078,405 | 1/1992 | Jones et al. | 273/309 |
| 5,100,137 | 3/1992 | Fulton | 463/13 |
| 5,248,142 | 9/1993 | Breeding | 273/138 R |
| 5,255,915 | 10/1993 | Miller | 463/13 |
| 5,265,882 | 11/1993 | Malek | 273/292 |
| 5,288,077 | 2/1994 | Jones | 273/292 |
| 5,288,081 | 2/1994 | Breeding | 273/292 |
| 5,308,065 | 5/1994 | Bridgeman et al. | 463/13 |
| 5,356,140 | 10/1994 | Dabrowski et al. | 463/13 |
| 5,364,104 | 11/1994 | Jones et al. | 273/292 |
| 5,364,105 | 11/1994 | Jones | 273/292 |
| 5,377,973 | 1/1995 | Jones et al. | 463/13 |
| 5,377,993 | 1/1995 | Josephs | 273/292 |
| 5,377,994 | 1/1995 | Jones | 273/309 |
| 5,380,012 | 1/1995 | Jones et al. | 273/292 |
| 5,382,025 | 1/1995 | Sklansky et al. | 273/292 |
| 5,411,257 | 5/1995 | Fulton | 463/13 |
| 5,417,430 | 5/1995 | Breeding | 273/292 |
| 5,437,451 | 8/1995 | Fulton | 273/138 A |
| 5,544,892 | 8/1996 | Breeding | 273/292 |
| 5,544,893 | 8/1996 | Jones et al. | 273/309 |
| 5,851,011 | 12/1998 | Lott | 273/292 |

*Primary Examiner*—Benjamin H. Layno

*Attorney, Agent, or Firm*—Koley, Jessen, Daubman & Rupiper, P.C.; Mark D. Frederiksen

[57] ABSTRACT

A method of playing a casino type wagering card game includes the initial step of each player placing an initial wager. Five cards are then dealt to each player and seven cards are dealt to the dealer. Each player may then inspect the original dealt hand, and elect to stay pat or discard and draw one or two cards. If the player elects to draw, they then inspect the new draw hand and either fold or place a second wager to stay with the draw hand. All discarded cards are then collected by the dealer and the dealer selects the best five card hand, based on poker criteria, from the dealer's cards. A comparison is then made between the player's hand and the dealer's selected hand. If the player stayed pat and has a hand higher than the dealer's hand, the player is awarded odds on the initial wager. If the player stays with the draw hand, and has a hand higher than the dealer's hand, the player is awarded even money on the initial wager and the second wager. If the dealer's hand is higher than the player's hand, the player loses the initial wager and the second wager if applicable. If the player's hand and the dealer's hand are the same rank, a "push" will result, and the player neither wins nor loses money.

27 Claims, 1 Drawing Sheet

METHOD FOR PLAYING A WAGERING TYPE CARD GAME

TECHNICAL FIELD

The present invention relates generally to wagering type card games, and more particularly to a casino style card game which combines aspects of five card draw poker and seven card stud poker.

BACKGROUND OF THE INVENTION

Much of the world has been intrigued with casino games since their existence. Now that the casino industry is growing so rapidly, the world is becoming more and more familiar with casino games.

Poker is one of the most popular card games which may be found in casinos. The major reason for this worldwide popularity is due to the countless poker variations that meet the temperaments of card players of all nations. One of the most popular variations is draw poker. This is a variation of poker wherein a player may discard one or more of the cards in his hand and draw new cards. The object of the game is to form the hand with the highest rank according to the conventional rules of poker. Five card poker hands are ranked according to the following order, with the royal flush being of the highest rank: (1) royal flush, (2) straight flush, (3) four of a kind, (4) full house, (5) flush, (6) straight, (7) three of a kind, (8) two pair, (9) one pair, and (10) high card.

Casino type games are well known in areas where gambling casinos have been legalized. Casino type games, as opposed to home type individual player games, are games in which the player plays against the "house", and sometimes against other players at the table. Typical examples of casino type games include blackjack, craps, roulette, baccarat, etc.

There are numerous wagering games which are currently known and used in the casino industry. In general, these casino games are uncomplicated and easily understood by the participants. The games should be exciting, to stimulate player interests, and have a quick outcome to resolve wagering during the game. The game must appear to provide favorable odds to the player, while actually having unvarying odds which favor the house.

SUMMARY OF THE INVENTION

It is therefore a general object of the present invention to provide an improved casino type wagering card game.

These and other objects of the present invention will be apparent to those skilled in the art.

The method of playing a casino type wagering card game of the present invention includes the initial step of each player placing an initial wager. Five cards are then dealt to each player and seven cards are dealt to the dealer. Each player may then inspect the original dealt hand, and elect to stay pat or discard and draw one or two cards. If the player elects to draw, they then inspect the new draw hand and either fold or place a second wager to stay with the draw hand. All discarded cards are then collected by the dealer and the dealer selects the best five card hand, based on poker criteria, from the dealers cards. A comparison is then made between the player's hand and the dealer's selected hand. If the player stayed pat and has a hand higher than the dealer's hand, the player is awarded odds on the initial wager. If the player stays with the draw hand, and has a hand higher than the dealer's hand, the player is awarded even money on the initial wager and the second wager. If the dealer's hand is higher than the players hand, the player loses the initial wager and the second wager if applicable. If the player's hand and the dealer's hand are the same rank, a "push" will result, and the player neither wins nor loses money.

BRIEF DESCRIPTION OF THE DRAWINGS

The FIGURE shows a game layout which may be utilized to play the game of the present invention.

DESCRIPTION OF THE PREFERRED EMBODIMENT

Figure 1:
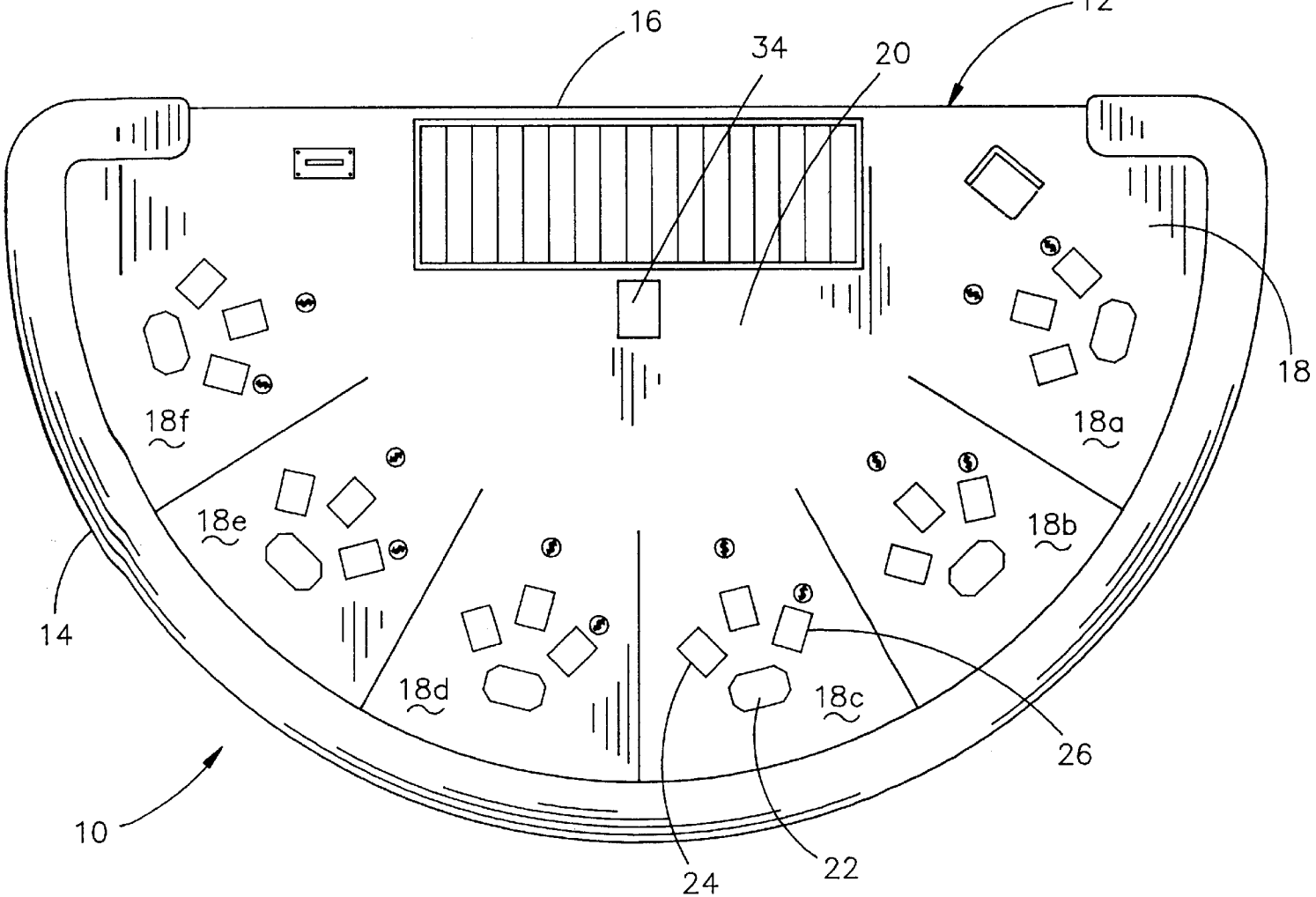

Referring now to the drawings, the apparatus for the casino type wagering card game of the present invention is designated generally at 10 and includes a conventional casino style gaming table 12 having a curved side 14 for accommodating six players, and a straight side 16 for accommodating the house dealer. Table 12 has a playing surface 18 covered with felt or other appropriate materials. Six player positions are designated generally at 18*a* through 18*f* along the curved side 14 of table 12, for individual players, are provided on table 12. The dealer's playing position is designated generally at 20 on table 12.

Each player position 18*a* through 18*f* is identical, and only one position will he described in detail herein. As can be seen at position 18*c*, the player position has an initial wagering area 22, where the initial ante wager is placed. The pat stay box 24 is an area designated for placing cards is a player elects to stay with their original five cards. The draw stay box 26 is an area designated for placing cards if a player elects to stay after drawing one or more cards. The stay circle 28 is an area designated for placing a second wager if the player elects to stay after drawing. The discard and fold box 30 is a region designated for placement of discarded cards. A jackpot circle 32 is provided to designate a location for an alternate bonus wager.

The dealer's position 20 will simply have a box 34 upon which the dealer will display a selected five card hand.

In the preferred embodiment of the game, a single deck of 52 conventional playing cards are used, and at least one player located at one of the player positions 18*a* through 18 f*is* required. After the cards are shuffled, each player is dealt five cards, face down, and the cards are placed directly in front of each player at player positions 18*a* through 18*f* (but only at a position where a player is seated). The dealer then deals seven cards face down to the dealer position 20, in box 34.

Once the players and dealer have received their cards, the players are allowed to inspect their hands. Each player then has the option to either stay pat or to better their hand by discarding one or more cards and receiving additional cards to replace the discarded cards. In the preferred embodiment, the player is limited to discarding up to two cards.

Once the dealer has collected all discarded cards, the dealer will deal additional cards to each player so that the player receives a five card hand. Once all additional cards have been dealt, the players are permitted to inspect their new hands.

Each player that has received a new hand must then elect to either fold, and forfeit the initial wager or to stay with the new hand. If the player stays with the new hand, the player must place a second wager in the stay circle 28. Each player that stayed pat on the original deal retains their cards in the pat stay box 24, while each player that stays after discarding and receiving a draw of additional cards retains their cards in the draw stay box 26. If a player folds, or discards cards, these cards are placed in box 30.

Once each player has either stayed, or folded, the dealer turns the dealer's seven cards over and selects the best five card hand from the seven cards. The dealer then turns over each player's hand individually, and a comparison is made between the player's hand and the dealer's hand.

If an individual player's hand is higher than the dealer's hand, according to conventional poker rank, the player wins an amount determined by whether they stayed pat, or drew additional cards. A stay pat hand is awarded odds based on the initial wager. The preferred pay out schedule for a stay pat hand is as follows:

| | |
|---|---|
| Royal Flush | 500 to 1 |
| Straight Flush | 100 to 1 |
| Four of a Kind | 20 to 1 |
| Full House | 10 to 1 |
| Flush | 5 to 1 |
| Straight | 4 to 1 |
| Three of a Kind | 3 to 1 |
| Two Pair | 2 to 1 |
| All other hands | 1 to 1 |

If the player drew additional cards, and the player's hand is higher than the dealer's hand, then the player wins even money on the initial wager and the second wager.

If the dealer's hand is of higher rank than the player's hand, then the player losses the initial wager as well as the second wager (if the player placed a second wager). If the player's hand and the dealer's hand are of the same rank, a "push" will result, and the player neither loses nor wins any money.

If a player wins, the player is immediately awarded payment. If a player loses, the dealer immediately collects the wagered bets. All cards are then retrieved and reshuffled for a new hand.

The jackpot circle 32 is utilized as an elective side bet. The player may partake in the jackpot wager by placing a designated jackpot bet in jackpot circle 32 at the same time as the initial wager is placed. Once all of the hands have been revealed and compared with the dealer hand, the jackpot is awarded if the player's hand is of a predetermined rank (regardless of the rank of dealer's hand), the award being paid at higher odds for receiving a hand of that predetermined rank. Preferably, the jackpot is awarded in two different pay out schedules, one of higher odds for a qualified pat hand and a separate pay out schedule for lower odds for a qualified draw hand. The following jackpot pay out schedule is preferred:

| Pat Hand Pay Out Schedule | | Draw Hand Pay Out Schedule | |
|---|---|---|---|
| Royal Flush | 1,000 to 1 | Royal Flush | 500 to 1 |
| Straight Flush | 750 to 1 | Straight Flush | 100 to 1 |
| Four of a Kind | 500 to 1 | Four of a Kind | 50 to 1 |
| Full House | 200 to 1 | Full House | 20 to 1 |
| Flush | 100 to 1 | Flush | 4 to 1 |
| Straight | 50 to 1 | Straight | 2 to 1 |
| Three of a Kind | 5 to 1 | | |

If the player does not receive a hand which qualified for the jackpot pay out, the dealer will collect the jackpot wager immediately after the player folds, or at the end of the hand.

In a second embodiment of the method for playing the casino type wagering card game, the player would be required to pay a draw fee if the player elects to discard and draw cards after the initial deal. In addition, a player staying with a pat hand is also required to place a stay bet, the same as a player who elects to stay with a hand after drawing one or more cards.

In the second embodiment of the invention, the dealer must also have a predetermined hand of a minimum rank to "qualify". If the dealer's hand does not qualify, the players who have not folded are paid even odds on their initial wagers, and any draw fees and stay bets are returned to them. If the dealers hand does qualify, a comparison of the dealer's hand is made with each of the player's hand. If the player's hand is higher than the dealer's hand, the player is awarded odds on the stay bet, depending upon the rank of the hand, and based upon a predetermined pay out schedule. Each player is also awarded even odds on the initial wager, and the draw fee (if paid) is returned.

In a third embodiment of the invention, a player that elects to stay pat with their original five card hand must place a stay wager equal to double the initial wager. If the player draws, and elects to stay with their new hand, then the player must pay a wager double the initial wager to stay. Two separate pay out schedules are used in this embodiment of the invention, and the player is awarded odds for having a better hand than the dealer's hand. The schedules differ on the basis of whether the player stayed pat with the original five card hand, or elected to draw cards. The odds are higher for a player who stayed pat, as compared to a player who drew cards.

Whereas the invention has been shown and described in connection with the preferred embodiment thereof, many modifications, substitutions and additions may be made which are within the intended broad scope of the appended claims.

I claim:

1. A method of playing a casino type wagering card game, comprising the steps of:

(a) providing at least one conventional deck of 52 playing cards;

(b) a player anteing an initial wager;

(c) a dealer dealing a hand comprising at least five original cards to the player;

(d) the dealer dealing a hand comprising greater than five cards to the dealer;

(e) the player either staying pat, or discarding less than five cards;

(f) the dealer dealing a number of additional cards to the player equal to the number of cards discarded, if the player discarded cards;

(g) if the player was dealt additional cards, the player then either folding, in which case the player loses the initial wager to the dealer, or betting a second wager;

(h) the dealer selecting five cards from the dealer's hand to form a hand highest possible poker rank, and revealing the hand of said five original cards to the player;

(i) comparing the player's hand to the dealer selected hand, using poker rank as the criterion for comparison;

(j) if the player's hand is higher than the dealer's hand, and the player's stayed pat with the original cards dealt, then the player wins a predetermined amount on the player's initial wager, based on the type of poker hand combination of the player's hand;

(k) if the player's hand is higher than the dealer's hand, and the player discarded and received additional cards, then the player wins an amount equal to the total of the player's initial wager and the player's second wager;

(l) if the dealer's hand is higher than the player's hand, the player loses the initial wager if the player's stayed pat, or the player loses both the initial and second wager if the player discarded and received additional cards;

(m) if the player's hand and the dealer's hand are equal in rank, a "push" will result, and the player neither loses nor wins any money.

2. The method of claim 1, wherein the player is dealt exactly five cards.

3. The method of claim 2, wherein the dealer is dealt exactly seven cards.

4. The method of claim 3, wherein the player cards are dealt face down.

5. The method of claim 4, wherein the dealer cards are dealt face down.

6. The method of claim 5, wherein the player may discard and receive only one or two cards.

7. The method of claim 6, wherein the second wager is one-half the initial wager.

8. The method of claim 7, wherein standard playing cards are used.

9. The method of claim 8, wherein the predetermined amount that the player wins on the initial wager is according to the following pay out schedule:

| | |
|---|---|
| Royal Flush | 500 to 1 |
| Straight Flush | 100 to 1 |
| Four of a Kind | 20 to 1 |
| Full House | 10 to 1 |
| Flush | 5 to 1 |
| Straight | 4 to 1 |
| Three of a Kind | 3 to 1 |
| Two Pair | 2 to 1 |
| Any other hand | 1 to 1. |

10. The method of claim 1, wherein the dealer is dealt exactly seven cards.

11. The method of claim 1, wherein the player may discard and receive only one or two cards.

12. The method of claim 11, wherein the stay fee is an amount equal to one-half the initial wager.

13. The method of claim 1, wherein the second wager is one-half the initial wager.

14. The method of claim 1, wherein the predetermined amount that the player wins on the initial wager is according to the following pay out schedule:

| | |
|---|---|
| Royal Flush | 500 to 1 |
| Straight Flush | 100 to 1 |
| Four of a Kind | 20 to 1 |
| Full House | 10 to 1 |
| Flush | 5 to 1 |
| Straight | 4 to 1 |
| Three of a Kind | 3 to 1 |
| Two Pair | 2 to 1 |
| Any other hand | 1 to 1. |

15. The method of claim 1, wherein the dealer's hand is dealt face down except the last card, which is dealt face up.

16. The method of claim 1, wherein the step of the player staying pat or discarding less than five cards includes the step of paying a predetermined draw fee if the player elects to discard and draw additional cards.

17. The method of claim 16, further comprising the steps of:

determining if the dealer's selected hand is at least a predetermined rank, after the step of revealing the dealer's hand; and if the dealer's hand is not at least a predetermined rank, the player wins an amount equal to the player's initial bet, the draw fee and second wager being returned to the player.

18. The method of claim 17, wherein the dealer's hand is dealt face down except the last card, which is dealt face up.

19. The method of claim 18, further comprising the step of:

if the dealer's hand exceeds a predetermined rank, and the player's hand is higher than the dealer's hand, then the player additionally wins:

(1) an amount equal to the player's initial wager;

(2) a second predetermined amount on the player's second wager, based on the type of poker hand combination of the player's hand; and (3) the draw fee is returned.

20. The method of claim 1, wherein the step of the player's staying pat or discarding includes the step of paying a predetermined stay fee if the player elects to stay pat.

21. The method of claim 1, further comprising the steps of: the player placing a jackpot bet in a jackpot location at the same time as the initial wager;

after the step of the dealer revealing the dealer's hand, and if the player has not folded, if the player's hand exceeds a predetermined rank, the player wins a predetermined jackpot amount on the jackpot bet based upon the type of poker hand combination held by the player; and if the player's hand does not exceed a predetermined rank, the player loses the jackpot bet.

22. The method of claim 21, wherein the predetermined jackpot amount that the player wins on the jackpot bet is according to the following schedule:

| Pat Hand Pay Out Schedule | | Draw Hand Pay Out Schedule | |
|---|---|---|---|
| Royal Flush | 1,000 to 1 | Royal Flush | 500 to 1 |
| Straight Flush | 750 to 1 | Straight Flush | 100 to 1 |
| Four of a Kind | 500 to 1 | Four of a Kind | 50 to 1 |
| Full House | 200 to 1 | Full House | 20 to 1 |
| Flush | 100 to 1 | Flush | 4 to 1 |
| Straight | 50 to 1 | Striaght | 2 to 1 |
| Three of a Kind | 5 to 1. | | |

23. A method of playing a game involving a plurality of players and a dealer, comprising the steps of:

(a) providing at least one conventional deck of 52 playing cards;

(b) each player anteing an initial wager;

(c) the dealer dealing a hand comprising at least five cards to each player;

(d) the dealer dealing a hand comprising greater than five cards to the dealer;

(e) each player either staying pat, or discarding less than five cards;

(f) the dealer dealing a number of additional cards to each player that discarded cards, the number of additional cards being equal to the number of discarded cards to each player;

(g) each player dealt additional cards either folding, in which case the player loses the initial wager to the dealer, or betting a second wager;

(h) the dealer selecting five cards from the dealer's hand forming a hand of highest possible poker rank, and revealing the selected hand to the players;

(i) each player comparing the player's hand to the dealer selected hand, using poker rank as the criterion for comparison;

(j) if the player's hand of said five original cards is higher than the dealer's hand, and the player stayed pat with the original cards dealt, then the player wins a predetermined amount on the player's initial wager, based on the type of poker hand combination of the player's hand;

(k) if the player's hand is higher than the dealer's hand, and the player discarded and received additional cards, then the player wins an amount equal to the total of the player's initial wager and the player second wager;

(L) if the dealer's hand is higher than the player's hand, the player loses the initial wager if the player stayed pat, or the player loses both the initial and second wager if the player discarded and received additional cards;

(m) if the player's hand and the dealer's hand are equal in rank, a "push" will result, and the player neither loses nor wins any money.

24. The method of claim 23, wherein the dealer collects all discarded cards from the players prior to dealing additional cards to the players.

25. The method of claim 23, wherein the player is dealt exactly five cards.

26. The method of claim 23, wherein the dealer is dealt exactly seven cards.

27. The method of claim 23, wherein the predetermined amount that the player wins on the initial wager is according to the following pay out schedule:

| | |
|---|---|
| Royal Flush | 500 to 1 |
| Straight Flush | 100 to 1 |
| Four of a Kind | 20 to 1 |
| Full House | 10 to 1 |
| Flush | 5 to 1 |
| Straight | 4 to 1 |
| Three of a Kind | 3 to 1 |
| Two Pair | 2 to 1 |
| Any Other Hand | 1 to 1. |

* * * * *